United States Patent [19]

Alston

[11] 4,321,788

[45] Mar. 30, 1982

[54] OPEN END SPINNING APPARATUS

[75] Inventor: Otis B. Alston, Wetumpka, Ala.

[73] Assignee: Dixie Yarns, Inc., Chattanooga, Tenn.

[21] Appl. No.: 871,142

[22] Filed: Jan. 20, 1978

[51] Int. Cl.[3] ..... D01H 7/895

[52] U.S. Cl. ..... 57/58.95; 19/105; 19/114; 19/115 R; 19/128

[58] Field of Search ..... 57/58.89–58.95; 19/82, 83, 105, 98, 99, 104, 112, 128, 113, 114, 115 R

[56] References Cited

U.S. PATENT DOCUMENTS

| | | | |
|---|---|---|---|
| 2,044,460 | 6/1936 | Bartram et al. | 19/112 X |
| 3,119,223 | 1/1964 | Meimberg | 57/58.95 X |
| 3,360,918 | 1/1968 | Doudlebsky et al. | 57/58.95 |
| 3,439,488 | 4/1969 | Bucil et al. | 57/58.95 |
| 3,571,859 | 3/1971 | Doudlebsky et al. | 57/58.95 X |
| 3,584,451 | 6/1971 | Chrtek et al. | 57/58.95 |
| 3,604,062 | 9/1971 | Hollingsworth | 19/113 |
| 3,884,028 | 5/1975 | Stahlecker et al. | 57/58.95 X |
| 3,894,386 | 7/1975 | Sharychenkov et al. | 57/58.95 |
| 3,938,310 | 2/1976 | Didek et al. | 57/58.95 X |
| 3,975,895 | 8/1976 | Stahlecker | 57/58.95 |
| 3,986,329 | 10/1976 | Safar | 57/58.95 |
| 4,083,085 | 4/1978 | Livingston et al. | 19/105 |

FOREIGN PATENT DOCUMENTS

| | | | |
|---|---|---|---|
| 2127050 | 12/1971 | Fed. Rep. of Germany | 57/58.95 |
| 2134342 | 1/1972 | Fed. Rep. of Germany | 57/58.95 |
| 2606193 | 9/1976 | Fed. Rep. of Germany | 57/58.95 |
| 2532993 | 2/1977 | Fed. Rep. of Germany | 57/58.91 |
| 2364983 | 5/1977 | France | 19/105 |
| 74205 | 6/1970 | German Democratic Rep. | 19/105 |
| 8080 | of 1890 | United Kingdom | 19/105 |
| 400971 | 11/1933 | United Kingdom | 19/104 |
| 702713 | 1/1954 | United Kingdom | 19/105 |
| 832803 | 4/1960 | United Kingdom | 19/105 |
| 960637 | 6/1964 | United Kingdom | 19/105 |
| 1278045 | 6/1972 | United Kingdom | 19/104 |
| 1361986 | 7/1974 | United Kingdom | 19/105 |

OTHER PUBLICATIONS

Szaloki, "High Speed Carding and Continuous Card Feeding", vol. II, 1977.

Hamby, "Carding and Combing", American Cotton Handbook, vol. One, 1965.

*Primary Examiner*—John Petrakes

*Attorney, Agent, or Firm*—Stevens, Davis, Miller & Mosher

[57] ABSTRACT

An aero-mechanical open-end spinning machine, in which feedstock fibers pass between the teeth of the combing roller and the teeth of a combing sector facing the combing roller, and are thereby paralleled prior to their entry into the air stream by which they are delivered to the spinning rotor.

14 Claims, 4 Drawing Figures

OPEN END SPINNING APPARATUS

BACKGROUND

This invention relates to systems for open-end spinning, and particularly to systems for aero-mechanical open-end spinning.

The technique for open-end spinning is process of separating staple fibers from an input feedbunch and transporting them to a revolving open-end reassembly and twisting point to form a yarn. There are at least three main approaches to open-end spinning: aero-dynamic systems, electro-mechanical systems, and aero-mechanical systems.

In aero-dynamic systems, a spiral airflow is produced downwardly in a tube into which separated staple fibers are introduced by means of a secondary air inlet. A seed yarn is introduced into the spiral flow, and the separated fibers gather on its tail. The seed yarn is withdrawn from the tube and, as it is withdrawn, the staple fibers gathered on it are twisted by the rotation of the yarn in the airstream. The yarns produced by this method are, however, weak and irregular.

In electro-mechanical systems, electrostatic forces generated from high potentials (on the order of 30 kilovolts) transport the separated staple fibers from a drafting system, and hold them in control during the mechanical twisting action imparted by a rotating needle basket.

In aero-mechanical systems, the separated staple fibers are delivered along with the air stream into a revolving rotor (often referred to as a spinning rotor or turbine), forming a fiber ring around the periphery thereof. A seed yarn is introduced into the rotor, and its tail collects the fibers lying around the periphery. The fibers so collected are twisted into the yarn by the rotation of the rotor as the seed yarn is withdrawn. This is a system of open-end spinning which has been commercially exploited. Machines employing this system including that manufactured by Toyoda Automatic Loom Works, Ltd. of Aichi-ken, Japan, known as Model BS, and that manufactured by Schurr, Stahlecker and Grill GmbH, Suessen, West Germany, known as the Suessen Open-End Spintester. Such open end spinning machines have been described in detail in numerous publications and patents.

Despite its commercialization, the yarn produced by present aero-mechanical systems does not possess the strength or quality of yarn produced by the more conventional ring spinning systems.

In aero-mechanical systems, an important factor in producing yarn comparable in strength with ring spun yarns is the parallelism of the separated staple fibers which form the fiber ring around the periphery of the revolving rotor. As is known in the prior art, the separation of staple fibers in the aero-mechanical systems presently in use is effected by a toothed combing roller. In such systems it would be beneficial to the production of high quality yarn if the separated staple fibers could be paralleled as they leave the combing roller and enter the airstream to be deposited on the periphery of the revolving rotor in a more parallel condition.

BRIEF SUMMARY OF THE INVENTION

It is the object of the present invention to provide an open-end spinning system which will produce yarn having a larger number of parallel fibers.

The foregoing object and others are accomplished in accordance with the present invention by employment in an open-end spinning system of a combing sector comprising a plurality of rows of combing teeth, said rows aligned concentric to the path of feedstock flow and located concentric and closely spaced outside the periphery of the working surface of the combing roller. Thus, as the fiber feedstock is combed, the fibers pass between the teeth of the combing roller and the teeth of the combing sector and in doing so are paralleled prior to their entry into the air stream by which they are delivered to the revolving spinning rotor.

BRIEF DESCRIPTION OF THE DRAWINGS

For a better understanding of the invention, as well as other objects and further features thereof, reference is made to the following detailed disclosure of preferred embodiments of the invention taken in conjunction with the accompanying drawings thereof, wherein.

DETAILED DESCRIPTION

Figure 1:
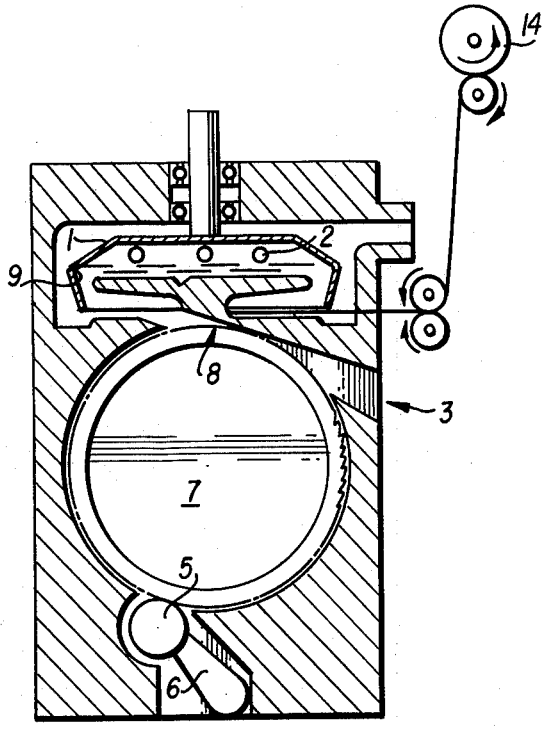
Fig. 1 PRIOR ART
FIG. 1 is a partially schematic, cross-sectional view of an exemplary prior art open-end spinning machine, the Toyoda Open End Spinning Machine.

The prior art machine of FIG. 1 is reviewed in the Publication "Technical Background of Toyoda Open-End Spinning," by T. Tooka, a Director of Toyoda Automatic Loom Works, Ltd., Toyoda-cho, Kariyashi, Aichi-Ken, Japan. As therein stated at page 3: FIG. 1 "illustrates a spinning unit of a Toyoda Open-End Spinning Machine. (1) indicates a . . . turbine. This has a number of holes (2) which serve as a fan when the turbine rotates at high speed. Air is sucked into the turbine through the inlet (3), flows through the path (4), and is delivered through the holes (2) into the diffuser installed outside the turbine.

"A sliver is carried by the feed roller (5) and the pressing nose (6), and transferred to the combing roller (7). Metallic wires in the shape of saw-teeth are wound round the combing roller, and fully comb the sliver fed to the combing roller. The combed fibers are pushed forward by the saw-teeth shaped wires, leave the combing roller at (8) and are transferred on an air stream to a portion of the inner wall of the turbine. This has its largest diameter (9), where the fibers are collected. They are then drawn out by a take-up roller, and wound into a cheese."

Figure 2:
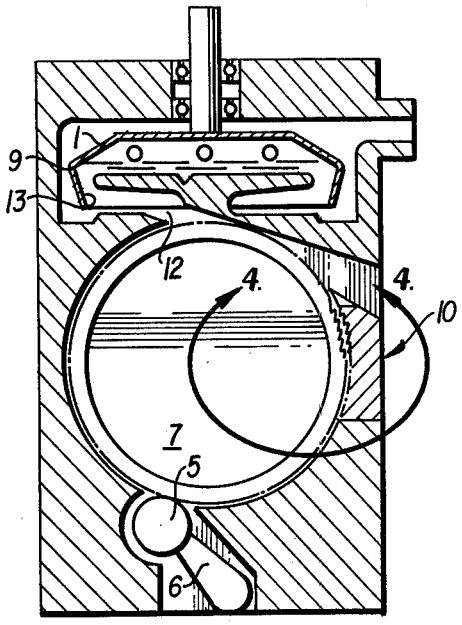
FIG. 2 is a partially schematic, cross-sectional view of a machine like that shown in FIG. 1, now including the present invention.
Figure 3:
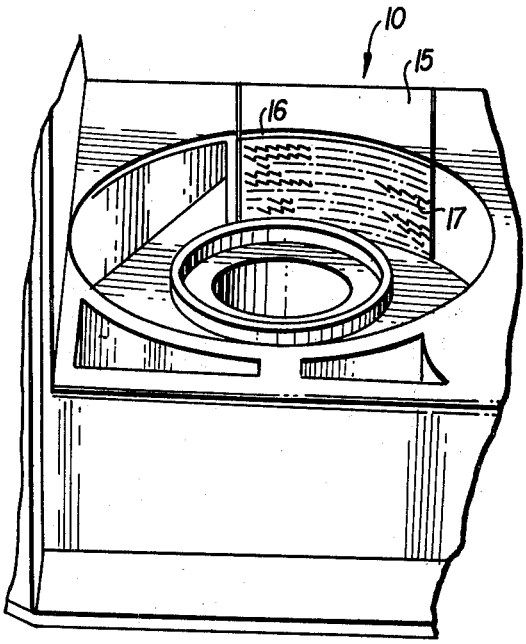
FIG. 3 is a partially schematic view which, in the absence of the combing roller, illustrates a combing sector typical of the present invention.

The placement of the combing section of the present invention is illustrated in FIGS. 2 and 3 wherein fiber feedstock is carried by feed roller 5 and pressing nose 6, and transferred to combing roller 7. The teeth of the combing roller transfer the fiber feedstock, carrying it forward past the combing section 10 of the present invention. The plurality of rows 17 of combing teeth which comprise the combing section substantially lie in parallel planes so that each row 17 is concentric to the path of feedstock flow. Thus when combing roller 7 carries the feedstock past combing section 10, the individual fibers are aligned parallel to each other in the direction of feedstock flow. The paralleled fibers then pass into air channel 12 through which air passes from inlet 3. The air stream carries the paralleled fibers into the interior of spinning rotor or turbine 1, where they are deposited on the wall 13 thereof, forming a fiber ring. This inner wall 13 has its largest diameter at 9, and it is along this diameter that the fiber ring is formed. A seed yarn, introduced into the rotor or turbine, collects the fibers in the fiber ring, on its tail. The fibers are then drawn out as yarn in the conventional manner by a take-up roller like 14 and wound onto a cheese. The operating parameters for the open-end spinning machine are not necessarily changed by employment of the present invention therein.

FIG. 3 illustrates a typical construction of the combing section or sector 10 of the present invention; it may be mounted on a base 15 to facilitate placement and adjustment thereof by slotted or extra large mounting holes. The combing sector 10 has a toothed surface 16 which is concentric to the toothed working surface of the combing roller with which it is intended to be associated. On surface 16 of the combing section are disposed rows 17 of teeth which rows are parallel to each other and lie in planes which are substantially radial to the axis of the combing roller. As further illustrated in FIG. 4 the teeth 18 in each row 17 of teeth in the combing section 10 are so arranged that their edges 19 facing the advancing feedstock F are approximately radial with respect to the combing roller, although in various embodiments for use with various fibers the angle of those facing edges may be varied. Similarly, the number of teeth per unit length in each row, and the number of rows may vary in different embodiments. For example, as presently known, the number of teeth per unit length may vary from about 5 to about 20 teeth per inch, and the number of rows of teeth may vary from about 12 to about 40 rows per inch (in the direction normal to said rows). The spacing 20 between the tips of the teeth in the combing section 10 and the tips of the teeth on the exterior surface of the combing roller 7 is typically set at close tolerances, for example on the order of about 0.005 to about 0.012 inches. It is believed that there may be a positive relationship between the total arcuate length of the combing section 10 and the length of the individual staple fibers being processed by the open-end spinning machine.

Alternately, rows of pins, needles or the like may perform the same function as the rows of teeth in the combing section 10. The combing section and the teeth thereof may be made of any hard, durable material. However, in a preferred embodiment the combing section comprises a series of rows of teeth each of which comprises teeth formed in a metal sawblade-type wire, a plurality of such sawblade wires being mounted on a rigid base which holds them in the desired position.

The present invention produces advantages in both yarn quality and yarn production. The yarns produced have an improved appearance because the fibers run through the combing section are more parallel to each other than those run through prior art open end spinning systems. Since the fibers are oriented more parallel to each other as they enter the spinning turbine or rotor, they twist more uniformly thereby giving an appearance more like that of ring spun yarns. Additionally, while open-end spun yarns are generally considered to be weaker than ring spun yarns, the present invention provides yarns of increased breaking strength over open-end spun yarns produced on comparable apparatus not including the presently claimed invention. Still further, the present invention decreases bunching and lumping type defects in the yarns entering the spinning turbine, thereby greatly decreasing the frequency of ends down during spinning. Yarns produced with the present invention also seem to have a more sheen or polished appearance than yarns made on comparable equipment not including the present invention.

The following examples further specifically define the improved open-end spinning system of the present invention. The examples below are intended to illustrate various preferred embodiments of the novel open end spinning system.

EXAMPLES I AND II

Figure 4:
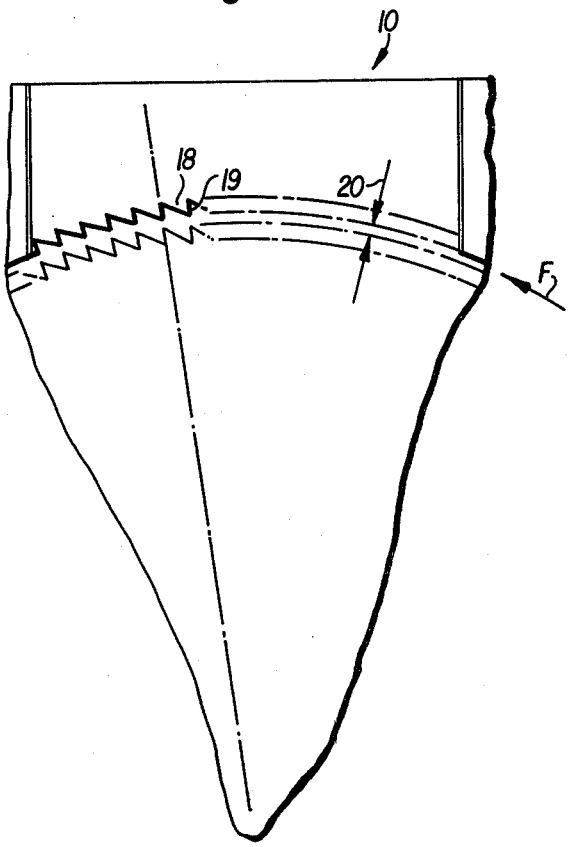
FIG. 4 is a partially schematic, enlarged view of the combing sector of FIG. 2.

The present invention was embodied in an open-end spinning machine, Model BS, manufactured by Toyoda Automatic Loom Works, Ltd., Toyoda-cho, Kariya-shi, Aichi-ken, Japan, which was modified by installation of a combing sector in accordance with the present invention. That combing sector comprises a sector of the housing for the combing rotor, which sector has an arcuate length of about $1\frac{1}{4}''$ located approximately as shown in FIGS. 2 and 3 hereof. The combing sector is a block firmly attached in place as shown in FIGS. 2 and 3, which block supports a number of rows of teeth oriented approximately as shown in FIGS. 2–4 hereof. Those rows of teeth are formed in metal sawblade-type wires mounted on the sector block. Each row contains about 21 teeth, and the rows are present in a population of about 18 rows per inch in the direction normal to the rows.

In the following table the data in column I is for operation of the standard Toyoda Model BS Open-End Spinning Machine, without the present invention. Column II contains data for operation of the same machine modified as described above to embody the present invention.

As shown in the table, yarns produced by the system including the present invention exhibit substantially increased yarn strength (as shown by the break factor data), increased yarn uniformity, decreased yarn fuzziness, and dramatic improvement in ends down during open-end spinning.

| | I | II | III | IV |
|---|---|---|---|---|
| Machine | Toyoda BS standard | Toyoda BS modified | Suessen standard | Suessen modified |
| Fiber | 100% Cotton | 100% Cotton | 100% Cotton | 100% Cotton |
| Rotor Speed | 30,000 RPM | 30,000 RPM | 30,000 RPM | 30,000 RPM |
| Comber Speed | 6,000 RPM | 6,000 RPM | 6,000 RPM | 6,000 RPM |
| Sliver wt./yd. | 56 grains | 56 grains | 56 grains | 56 grains |
| Yarn size | 18/1 | 18/1 | 18/1 | 18/1 |
| Break factor (on 120 yds.) | 2,096 lbs. | 2,344 lbs. | 1,996 lbs. | 2,187 lbs. |
| Uniformity | usual | more even | usual | more even about |
| Ends down | usual no. | about 300% improvement | usual no. | 300% improvement |
| Yarn Hairiness | Hairy | less fuzzy | Hairy | less fuzzy |

EXAMPLES III AND IV

The present invention was embodied in another open-end spinning machine, a Suessen Open-End Spintester machine manufactured by Spindelfabrik Suessen, Schurr, Stahlecker and Grill GmbH, 7334 Suessen, West Germany, which was modified by installation of a combing sector in accordance with the present invention. That combing sector comprises a sector of the housing for the combing rotor, which sector has an arcuate length of about 2½", located along the path which sliver takes around the combing rotor, in a region just in advance of the point at which the combed fibers of the sliver leave the combing rotor for entry into the air stream entering the turbine. The combing sector is a block, firmly attached adjacent the periphery of the combing rotor, which block supports a number of rows of teeth formed in sawblade-type wires, those wires being mounted on the block in a direction substantially parallel to the path of the sliver. Each row contains about 32 teeth, and the rows are present in a population of about 28 rows per inch in the direction normal to the rows.

In the foregoing table the data in column III is for operation of the standard Suessen Open-End Spintester Machine without the present invention. Column IV contains data for operation of the same machine modified as described above to embody the present invention.

As shown in the table, yarns produced by the system including the present invention exhibit substantially increased yarn strength (as shown by the break factor data), increased yarn uniformity, decreased yarn fuzziness, and dramatic improvement in ends down during open-end spinning.

EXAMPLES V AND VI

The apparatus described in Examples III and IV above was used as indicated in columns III and IV of the table, except that the input sliver was 75 grains/yard rather than 56 grains/yard. The standard Suessen Open End Spintester machine, without the present invention would not operate under those conditions. However the same machine modified to embody the present invention did operate, providing a sliver to yarn draft of 161.

This comparison shows that the present invention provides an additional economic advantage in that existing equipment can now be modified with the present invention to thereby process heavier input sliver. The greater drafting of the fibers results in a higher degree of parallel orientation thereof, and consequently less yarn hairiness or fuzziness.

Although specific components, proportions and arrangements of elements have been stated in the above description of preferred embodiments of this invention, other equivalent components and arrangements of elements may be used with satisfactory results and various degrees of quality, or other modifications may be made herein to enhance the construction of the invention to thereby increase its utility. It will be understood that such changes of details, materials, arrangements of parts, and uses of the invention described and illustrated herein, are intended to be included within the principles and scope of the claimed invention.

What is claimed is:

1. In an open-end spinning apparatus for manufacturing textile yarns, of the type comprising a feed roller for feeding sliver to a combing roller which has projections protruding from the cylindrical surface thereof, and a cup-like turbine into which combed fibers are transferred from the combing roller on an airstream, in which fibers are spun into yarn, and from which yarn is collected, the improvement comprising a combing sector for aligning textile fibers in a more mutually parallel condition, said combing sector comprising a surface including a plurality of rows of projections capable of retarding the passage of textile fibers contiguous the projections on the cylindrical surface of the combing roller, said surface being arcuate and said projections spaced adjacent the projections on the cylindrical surface of the combing roller, said rows being aligned in substantially parallel planes and substantially concentric with the combing roller.

2. The apparatus of claim 1 wherein said projections on the combing sector surface are teeth.

3. The apparatus of claim 2, wherein the number of teeth per unit length in each row is about 5 to about 20 teeth per inch.

4. The apparatus of claim 2, wherein the number of rows per unit length in the direction normal to said rows is about 12 to about 40 rows per inch.

5. The apparatus of claim 4 wherein said rows are spaced apart from each other without projections between said rows.

6. The apparatus of claim 2, wherein each row of teeth is formed in a metal sawblade-type wire.

7. The apparatus of claim 1 wherein said projections on the combing sector surface are pins or needles.

8. The apparatus of claim 1, wherein the tips of the projections on the combing sector surface are spaced from about 0.005 to about 0.012 inches from the tips of the projections on the cylindrical surface of the combing roller.

9. The apparatus of claim 1, wherein the combing sector comprises a removable unit attached to the apparatus.

10. The apparatus of claim 9, wherein said combing sector is adjustably attached to the apparatus.

11. The apparatus of claim 1 wherein said rows are spaced apart from each other without projections between said rows.

12. In an open-end spinning apparatus for manufacturing textile yarns, of the type comprising a feed roller for feeding sliver to a combing roller which has projections protruding from the cylindrical surface thereof, and a cup-like turbine into which combined fibers are transferred from the combing roller on an airstream, in which fibers are spun into yarn, and from which yarn is collected, the improvement comprising a combing sector for aligning textile fibers in a more mutually parallel condition, said combing sector comprising an arcuate surface having a plurality of rows of teeth capable of retarding the passage of textile fibers, said rows being aligned in substantially parallel planes and substantially concentric with the combing roller, the tips of said teeth being spaced adjacent the tips of the projections on the cylindrical surface of the combing roller, each row of said teeth being formed in a metal sawblade-type wire, with about 5 to about 20 teeth per inch in each row and about 12 to about 40 rows per inch in the direction normal to said rows.

13. The apparatus of claim 12, wherein the combing roller is adapted for rotation in the direction such that the airstream which transfers the combed fibers from said combing roller to the spinning turbine moves in the same direction as the periphery of said combing roller where they are substantially tangent.

14. The apparatus of claim 12, wherein said rows are spaced apart from each other without teeth between said rows.

* * * * *